US006109722A

United States Patent [19]

Underwood et al.

[11] Patent Number: 6,109,722

[45] Date of Patent: Aug. 29, 2000

[54] INK JET PRINTING SYSTEM WITH PEN ALIGNMENT AND METHOD

[75] Inventors: John A Underwood; Mark D Lund, both of Vancouver, Wash.

[73] Assignee: Hewlett-Packard Company, Ft. Collins, Colo.

[21] Appl. No.: 08/971,187

[22] Filed: Nov. 17, 1997

[51] Int. Cl.[7] ..... B41J 29/393

[52] U.S. Cl. ..... 347/19

[58] Field of Search ..... 347/19, 14, 37

[56] References Cited

U.S. PATENT DOCUMENTS

| | | | |
|---|---|---|---|
| 4,878,063 | 10/1989 | Katerberg | 346/1.1 |
| 5,250,956 | 10/1993 | Haselby et al. | 347/19 |
| 5,644,344 | 7/1997 | Haselby | 347/19 |
| 5,796,414 | 8/1998 | Sievert et al. | 347/19 |
| 5,847,722 | 12/1998 | Hackleman | 347/19 |

FOREIGN PATENT DOCUMENTS

| | | |
|---|---|---|
| 0589718A | 3/1994 | European Pat. Off. . |
| 0735504A2 | 10/1996 | European Pat. Off. . |
| 0867298A2 | 9/1998 | European Pat. Off. . |
| 0874329A | 10/1998 | European Pat. Off. . |

OTHER PUBLICATIONS

European Search Repor dated Mar. 10, 1999 for related European Patent Application 98309358,4–4304; filed Nov. 16, 1998.

*Primary Examiner*—Richard Moses

[57] ABSTRACT

An apparatus and method of aligning different color print heads of an ink jet printer by printing a sequence of extended-area first alignment elements in a first color, then printing an overlaying sequence of extended-area second alignment elements in a second color. Each of the alignment elements includes an array of spaced apart printed lines. The first alignment elements are printed to nominal reference positions, and the second alignment elements are offset from the reference positions by differing amounts. The degree of overlap of the first and second color lines is readily visible, and the most thoroughly overlapped alignment element may be readily identified. The identity of this element may then be fed back to the printer to respond with electronic alignment measures.

20 Claims, 2 Drawing Sheets

INK JET PRINTING SYSTEM WITH PEN ALIGNMENT AND METHOD

FIELD OF THE INVENTION

This invention related to printing systems, and more particularly to ink jet printers and plotters having multiple pens for multi-color operation.

BACKGROUND AND SUMMARY OF THE INVENTION

A typical ink jet printer, plotter, or other printing system has a pen that reciprocates over a printable surface such as a sheet of paper. The pen includes a print head having an array of numerous orifices or nozzles through which droplets of ink may be expelled into the surface to generate a desired pattern. Color ink jet printers typically employ four print heads, each connected to an ink supply containing a different color of ink (e.g. black, cyan, yellow, and magenta.) The different print heads may be included on separate, replaceable ink pens. A full color image may be printed by sequentially or simultaneously printing overlapping patterns with each of the different color inks. For good printed output, the patterns of different printed color images must be in precise registration. Registration errors occur because the print heads may differ in dimension by slight tolerances, and because removal and installation may prevent print head positioning from being precisely repeatable. At a typical 600 dots per inch (dpi) printer resolution, errors by more than one dot pitch are considered unacceptable.

In existing printers, registration of the different colors may be achieved without user involvement by printing an alignment pattern with each color, then visually or optically sensing the positions of the printed patterns and determining the amounts of any deviations from nominal aligned positions. The printer may then electronically adjust the firing position or timing for each color so that the resulting output is aligned. This is particularly critical for plotters printing on large media sheets, in which small errors may accumulate to provide unacceptable output.

For lower cost printers desired by many users, a vernier alignment pattern is printed, the user visually identifies which of several different black and color patterns is best aligned, and then enters the information into his computer or printer. A vernier alignment pattern is printed with a sequence of thin, equally spaced black lines serving as reference rulings. Adjacent to this pattern, a sequence of similar color lines is printed, except with a slightly wider or narrower spacing. A central one of the color lines is printed at a position nominally aligned with the corresponding black line, while each of the adjacent color lines is shifted from the nominal by a single dot pitch in opposite directions, and each further removed color line is shifted by an increased integral multiple of the dot pitch. While the black lines are spaced apart by n pixels, the color lines may be spaced apart by n+1 (or n−1) pixels.

If the pens are in proper alignment, the central color line will appear best aligned. If the pens are misaligned by "n" dot pitches in a given direction, the line pair located n units away from the central pair will appear best aligned. By identifying this pair, the user can instruct the printer to shift the print data in time, or to shift which nozzles to which the print data will map, to correct the error. This proceeds with each color, using black as the reference in each case, and includes rows of lines oriented in each orthogonal axis, to detect and correct misalignments in the scan axis and the feed axis of the printer. Scan axis errors are corrected by shifting the timing of printing the color droplets; feed axis errors are corrected by shifting the nozzles to which the print data corresponds.

While reasonably effective, the vernier alignment system requires critical visual acuity and skill that may be inadequate in some users. Also, chromatic aberrations caused by corrective eyewear and an imperfect viewing axis may cause an illusory shifting of different colors relative to the black reference lines. Most difficult is the alignment of the yellow ink used in typical four-color printers. A fine yellow line is difficult to discern on normal white printer paper, as there is insufficient contrast between the bright yellow figure and the bright white background. In addition, for vertical alignment (using horizontal lines parallel to the scan axis) only a single nozzle is used to print each color. Thus, an error on one nozzle could lead to a misalignment of the rest of the nozzles of that color.

The present invention addresses the disadvantages of the prior art by providing an apparatus and method of aligning different color print heads of an ink jet printer by printing a sequence of extended-area first alignment elements in a first color, then printing an overlaying sequence of extended-area second alignment elements in a second color. Each of the alignment elements includes an array of spaced apart printed lines. The first alignment elements are printed to nominal reference positions, and the second alignment elements are offset from the reference positions by differing amounts. The degree of overlap of the first and second color lines is readily visible, and the most thoroughly overlapped alignment element may be readily identified. The identity of this element may then be fed back to the printer to respond with electronic alignment measures.

DETAILED DESCRIPTION OF A PREFERRED EMBODIMENT

Figure 1:
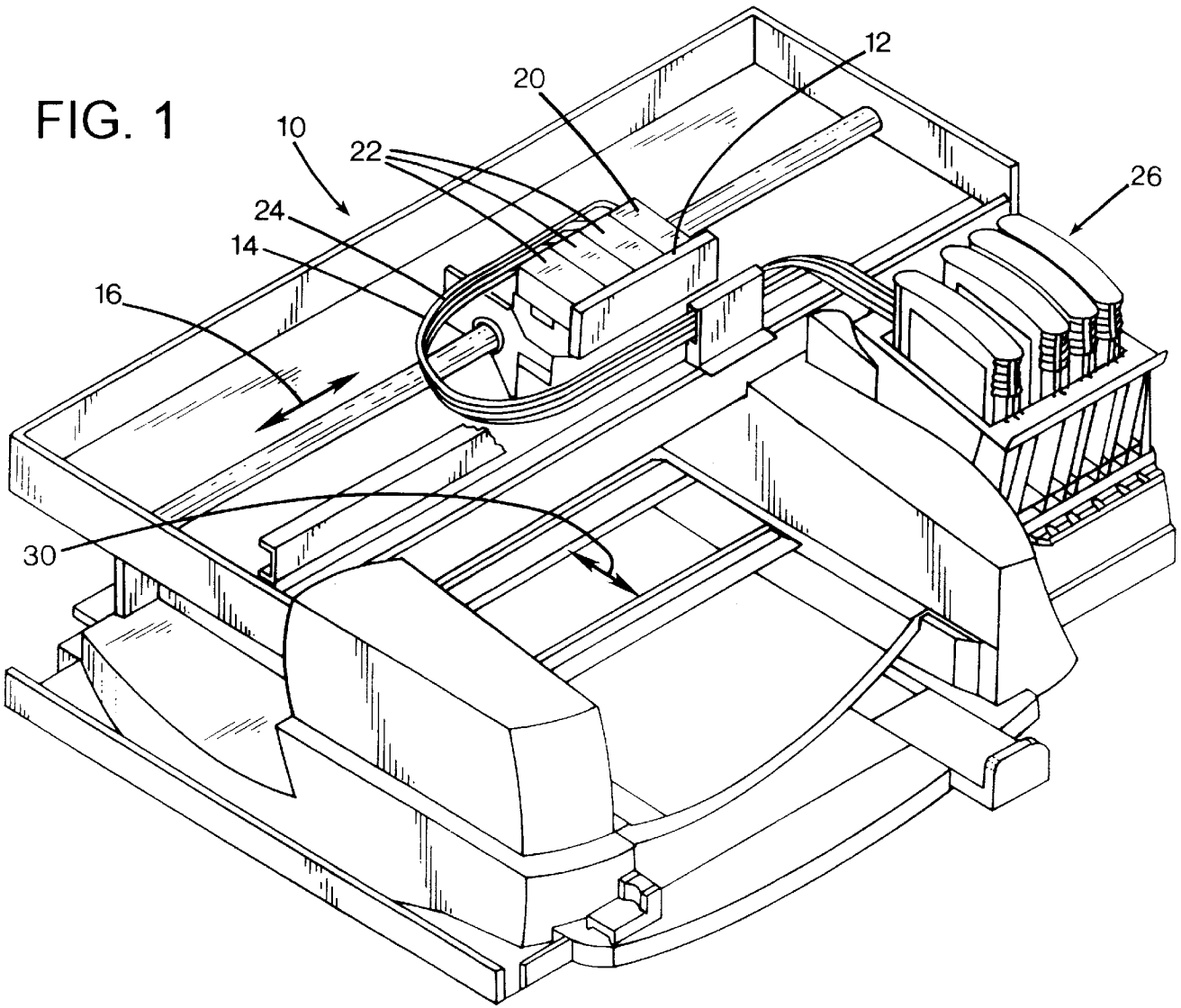
FIG. 1 is a perspective view of a printer according to a preferred embodiment of the invention.
Figure 2:
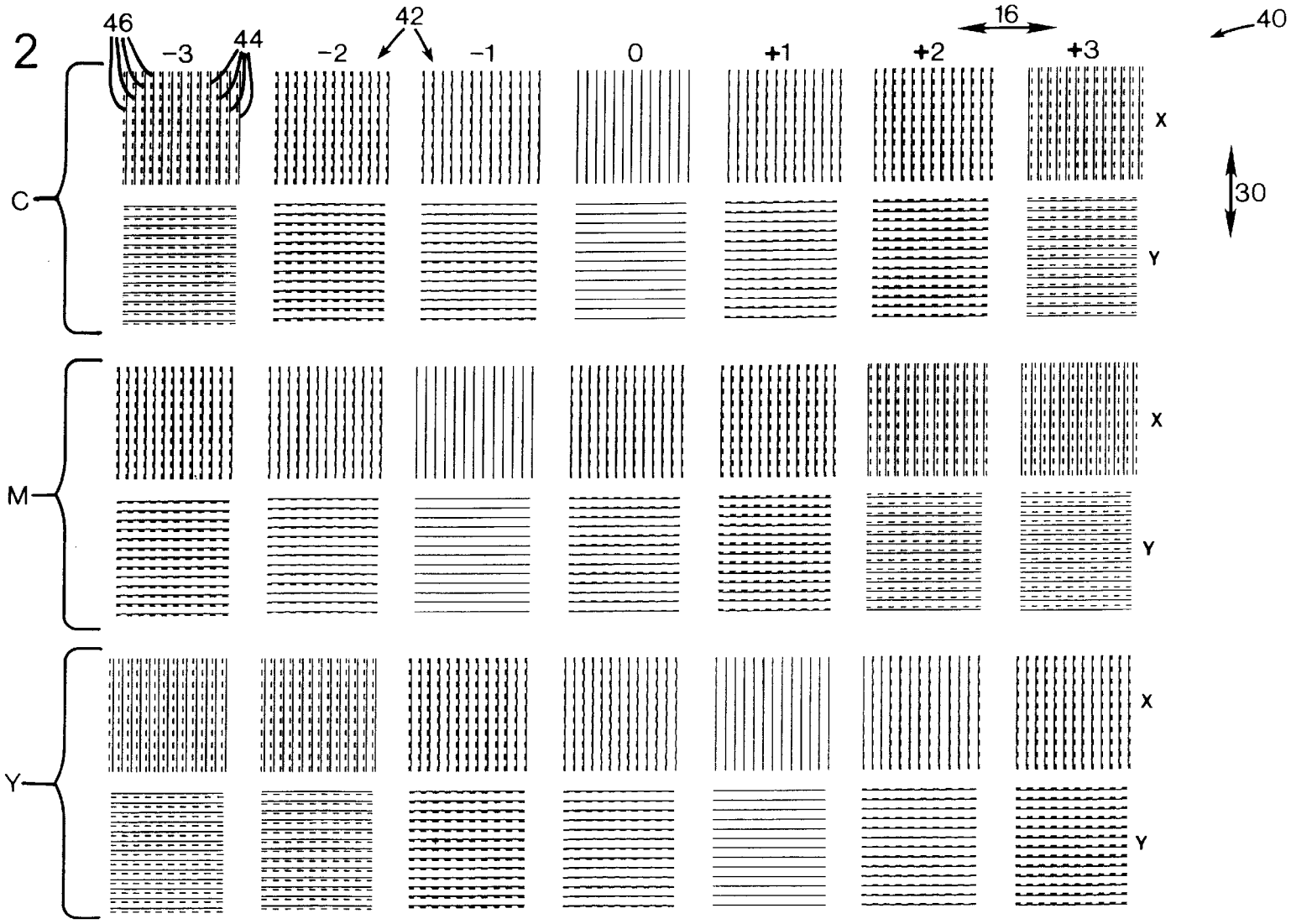
FIG. 2 is a plan view of a printer alignment pattern according to the embodiment of FIG. 1.

FIG. 1 shows an ink jet printer 10 having a carriage 12 that reciprocates on a rail 14 along a scan axis 16. The carriage supports four ink jet pens, a black pen 20, and three color pens 22. Each pen is connected by a flexible conduit 24 to a respective one of four ink reservoirs 26, and by a flexible electrical ribbon cable to a printer controller (not shown) provided by a microprocessor in the printer. A feed mechanism (not shown) has rollers that grip the sheet to move a media sheet beneath the carriage along a feed axis 30. The black pen has an elongated array of black nozzles connected to a black ink supply, and the color pen has three arrays of color nozzles, each connected to a respective supply of a particular color ink (cyan, yellow, and magenta). Each nozzle array is elongated along the feed axis so that it prints out a swath as the carriage moves along the scan axis.

The printer is connected to a computer in which printer driver or control software is installed. In this software, or in the printer controller, the instructions needed to print a four color alignment pattern 40 reside. The alignment pattern is oriented with respect to axes 16 and 30 as shown. The pattern includes three different color pattern sets C, M, and Y, which are used to align the cyan, magenta, and yellow pens respectively to the black pen. Each set includes an first row X and a second row Y of seven square alignment elements each. Each alignment element includes, an array of parallel black lines (shown in solid lines), and an overlaid array of parallel color lines (shown in dashed lines, and of the color of the color pattern set in which they reside.) Each line is as thin as possible, printed with a width of only one dot or pixel. The black and color lines are evenly spaced apart on the same pitch of eight times the dot pitch, which is 600 dpi in the preferred embodiment. Although shown enlarged, and with fewer lines per element for clarity, each element preferably has about 25 lines of each color, providing an element size of 200 dots or ⅓ inch (8.5 mm) on a side. This is a sufficiently extended area to be readily viewed by a user for alignment analysis, and to utilize a substantial portion or all nozzles of the pens used.

For simplicity and convenience, the pattern 40 is printed as a matrix of alignment elements 42, with six rows and seven columns. Each element has an extended area, so that its appearance may be noted by a typical user who does not necessarily discern the fine subelements that make up the element. Each alignment element includes a black portion made up of black lines 44, and an overlaying color portion of color lines 46. The upper row x of each color set has lines oriented horizontally, and the lower row x of each set has vertical lines. The columns are labeled −3, <2, −1, 0, +1, +2, +3. Thus any element may be identified by its color, orientation, and column, e.g. C−3x, M0y, Y+2y. The black line 44 patterns (solid) in each row are identical, and they are spaced apart regularly on a nominal element pitch that provides a small space between elements to permit them to be readily distinguished by a user. The color line 46 patterns (dashed) of each element are generally overlaid upon on the black pattern, except that most are shifted or offset slightly by differing amounts and directions. Printed indicia such as those in the illustration may indicate sets, columns, and rows to aid a user in identifying those that are in best alignment as will be discussed below.

The amount and direction by which the color patterns (shown dashed) are offset from the black patterns of each element is determined by the position in the alignment matrix. The column label indicates the magnitude of the shift, in dot pitch increments; the row indicates the direction, with rows labeled x having shifts only in a horizontal direction, and rows labeled y having shifts only in a vertical direction. Columns labeled with negative numbers have a color offset to the left or downward; columns labeled with positive numbers have a color offset to the right or upward. Column 0 is unshifted, with zero intended offset between black lines and the color lines in the event the pens are in perfect alignment. These patterns are described as nominally aligned, although they may be actually misaligned in the event of slight or significant misalignments. It is these misalignments that are to be visually made evident in the printed pattern, so that the user may identify and quantify the actual misalignments, and provide this information to the computer or printer. The printer may then use conventional adjustments of the timing or nozzle mapping to electronically compensate for the mechanical misalignment.

In the illustrated example, the Cyan pen is functioning in perfect alignment with the black pen, so that the nominally aligned patterns in the 0 column are in fact aligned. In this aligned condition, the black and color lines are fully overlapping. Regardless of whether the color or black ink is printed first, the black ink effectively prevents the color from being visible. As a result, the patches appear to a user as light gray. In columns −1 and +1 of the C set, the color lines are offset by one pixel from the black lines, in a perpendicular direction. Thus, the color and black lines are side-by-side, with minimal overlap, so that a major portion (or all) of the color lines is visible and unobstructed by the black line. The reflected light from these unobstructed color line portions provides to the user a clear impression of a muted color patch that is readily distinguishable from the aligned patch.

In the illustrated example, the Magenta pen is misaligned by one pixel to the right (in the positive x direction) and by one pixel upward (in the positive y direction). Close examination under magnification may reveal this characteristic in the appropriate rows of the 0 column. However, the misalignment may be readily detected by an untrained user with moderate visual acuity by noting that the patches M−1x and M−1y are gray in appearance, as the black lines obscure the color lines. This fact may then readily be fed back to the printer control logic. It is notable that although the x and y alignment errors are of the same magnitude and appear correlated, they may in other normal instances be entirely independent of each other, so that a positive horizontal misalignment of one magnitude and a negative vertical misalignment of a different magnitude may be detected and corrected.

The Yellow pen also exhibits a misalignment, to the left and down one pixel from the black reference patterns, and otherwise as the Magenta pen above.

Misalignments may occur by amounts other than a precise integral multiple of pixels pitch. If a misalignment of one half pixel (or an integral multiple plus one half) occurs in any given direction, there will be two adjacent patches that appear gray or nearly gray, due to the at least partial overlap of black and color ink in those patches. This represents the least correctable error, as a one half pixel error will remain after correction, regardless of which of the two patches appears the most gray (least color saturated) to the user. As the error remainder becomes slightly more or less than one half pixel, the user will have an easier time selecting the least colored gray patch, and the error will drift below one half pixel. Thus, the tolerance of the process is only slightly greater than plus or minus one half pixel, with the slight excess over one half arising from the chance of user error in a nearly, but not precisely one half pixel offset. Certainly, the error is less than one pixel, which is within normal design rules.

In alternative printers having the capacity to steer droplets, or otherwise vary their actual or apparent positions by varying drop ejection timing, drop volume, printing with adjacent droplets, pixel interpolation in software, or other means, the errors detected may be finer than one pixel. In these cases, the color pattern offset in the test pattern may be incremented by less than one pixel, and this may be different in the different axes or colors. In any embodiment, the process may proceed in multiple stages, with an initial test to provide approximate alignment, and a second test to provide a finer degree of discrimination, or simply to confirm the first adjustment. The test may also involve a limited number of nozzles, so that different segments of the nozzle array of a given color may be adjusted to compensate for differences within the array, or angular misalignment of the pen. This may be more pertinent to firing timing adjustments than to nozzle/pixel shifting measures.

In the preferred embodiment, there are seven columns in the test pattern. Thus, with the lines of the alignment elements being printed in every eighth dot row, it is possible that none of the patches demonstrates an aligned gray appearance. If this is a concern, additional patches having greater offsets may be added, or an additional test pattern for detecting offsets of a much larger magnitude may be used. A simple cross hair would suffice to provide this function, and to indicate when an apparently aligned pattern was actually offset by eight or more pixels. Additional cross hairs may be included with pixel offsets of 8n, to enable large offsets to be identified and corrected in a single test pattern. Such large shifts may also be readily identified by replacing the cross hairs with stripe patterns like those disclosed in the preferred embodiment, but with stripe widths of eight pixels, and the stripes spaced on 64 pixel centers.

While the invention is described in terms of a preferred embodiment, the claims are not intended to be so limited. For instance, the invention may apply to printers or other printing apparatus with any number of pens. The process may be used as a quality control measure at manufacturing or assembly, and for a printer with a single print head to confirm alignment of nozzles at one end of a print head with those on the other end. The system may apply to pens of the same color, with an intensity evaluation substituting for the color saturation evaluation. The evaluation step may be performed other than by a human user, such as by optical sensors in the printer, or by a separate instrument such as an electronic scanner. Each patch may be evaluated for color saturation by comparing the signal from an unfiltered photodetector with that from a color filtered photodetector.

It is also important to note that the printed patterns need not be square, but may be any extended shape. Also, the patterns need not be simple arrays of straight lines, but may include any pattern that will generate an overlap when aligned and will reveal both colors when misaligned. Multiple concentric circles, rectangles, and cross shapes may fulfill this need. In addition, the patches need not be stepped in uniform increments of offset. Also, the series of seven patches may be replaced with a stripe of continuously varying color offset, such as by printing fine color lines at a different dot pitch to achieve a moiré effect.

We claim:

1. A method of aligning different color print heads of an ink jet printer comprising the steps:

printing a sequence of extended-area first alignment elements in a first color;

printing an overlaying sequence of extended-area second alignment elements in a second color;

each of the alignment elements including an array of spaced apart printed sub elements;

printing the first alignment elements including directing the first elements to nominal reference positions; and printing the second alignment elements including directing at least some the elements to selected positions offset from the reference positions by differing amounts.

2. The method of claim 1 wherein each of the alignment elements includes an array of parallel lines having a common pitch.

3. The method of claim 1 wherein each of the alignment elements has a common pattern of subelements, such that registration of a first and second alignment elements will generate overlapping of the subelements.

4. The method of claim 1 wherein printing the first alignment elements includes positioning the first alignment elements in a line at a first selected pitch, and wherein printing the second alignment elements includes positioning the second alignment elements in a line at a second selected pitch different from the first pitch.

5. The method of claim 1 wherein each of the elements includes two arrays of parallel lines, the arrays perpendicularly oriented with respect to each other.

6. The method of claim 1 wherein printing the second elements includes directing one of the second elements to the respective reference position, and offsetting the other of the second elements each by a different offset amount along a common offset axis.

7. The method of claim 6 wherein the subelements are parallel lines oriented perpendicular to the offset axis.

8. The method of claim 6 wherein the offset amounts are integral multiples of a quantum offset amount.

9. The method of claim 8 wherein the quantum offset amount is equal to the dot pitch of the printer.

10. The method of claim 1 wherein printing the first alignment elements includes operating an active set of every nth nozzle on a first color print head for each of the alignment elements, and wherein printing a nominal one of the second alignment elements includes operating a corresponding active set of every nth nozzle on a second color print head, and printing a first offset one of the second alignment elements includes operating a different active set offset by one nozzle from the corresponding set.

11. The method of claim 10 wherein each of the second alignment elements is printed with a different active set of nozzles.

12. A method of calibrating an ink jet printer having a first printing element operable to print with a first ink, and a second printing element operable to print with a second ink, the method comprising the steps:

operating the first printing element to print a first plurality of pattern portions on a media sheet;

operating the second printing element to print a second plurality of pattern portions coextensive with the first pattern portions on the media sheet;

each of the first pattern portions having a respective pattern reference element at a respective nominal reference position;

each of the second pattern portions having a respective second pattern location element associated with the respective first pattern reference element, and at least some of the second pattern location elements offset from the nominal position by different incremental amounts, such that at least an aligned one of the pattern portions will include an overlapping reference element and location element, and such that at least a misaligned some of the pattern portions will include an offset reference element and location element;

determining which of the pattern portions is aligned; and in response to determining which of the pattern portions is aligned, setting the printer to operate the printing elements in alignment.

13. The method of claim 12 wherein the second printing element includes a linear array of nozzles, and wherein setting the printer includes shifting which nozzles correspond to a given data point.

14. The method of claim 12 wherein determining which of the pattern portions is aligned includes identifying which of the pattern portion includes overlapping printed portions.

15. The method of claim 12 wherein each of the pattern portions includes an array of spaced apart lines, and wherein printing the second pattern portions includes offsetting each of at least some of the second pattern portions by a different amount in a direction perpendicular to the lines.

16. The method of claim 12 wherein the second printing element includes a linear array of nozzles, and wherein printing the second pattern portions includes firing a different set of nozzles for each of the pattern portions.

17. The method of claim 12 wherein the second printing element includes a linear array of nozzles, and wherein printing the second pattern portions includes offsetting the firing timing by a different amount for at least some of the pattern portions.

18. A printer comprising:

a plurality of different color print heads operable to reciprocate over a media sheet and expel colorant onto the sheet;

control means for operating a first color print head to print a set of extended-area reference patterns in a first color, for operating a second color print head to print an associated set of second patterns in a second color to overlay the reference patterns, and for offsetting at least some of the second patterns by different amounts; and calibration means for setting the printing characteristics of the second print head in response to a determination of the relative alignment of the first and second print heads.

19. The apparatus of claim 18 wherein the control means is operable to generate a set of arrays of spaced apart lines.

20. The apparatus of claim 19 wherein the control means is operable to offset the second patterns in a direction perpendicular to the lines.

* * * * *